US011160317B2

(12) United States Patent
Barnett

(10) Patent No.: US 11,160,317 B2
(45) Date of Patent: Nov. 2, 2021

(54) ADIPOSE TISSUE BULGE MINIMIZING SYSTEM AND METHODS OF USE

(71) Applicant: Tina Barnett, Snellville, GA (US)

(72) Inventor: Tina Barnett, Snellville, GA (US)

( * ) Notice: Subject to any disclaimer, the term of this patent is extended or adjusted under 35 U.S.C. 154(b) by 288 days.

(21) Appl. No.: 16/129,725

(22) Filed: Sep. 12, 2018

(65) Prior Publication Data

US 2019/0075857 A1 Mar. 14, 2019

Related U.S. Application Data

(60) Provisional application No. 62/557,345, filed on Sep. 12, 2017.

(51) Int. Cl.

| | |
|---|---|
| ***A41D 1/22*** | (2018.01) |
| ***A41D 1/14*** | (2006.01) |
| ***A41F 1/00*** | (2006.01) |
| ***A41F 18/00*** | (2006.01) |
| ***A41D 27/00*** | (2006.01) |

(52) U.S. Cl.

CPC ..... *A41D 1/22* (2013.01); *A41D 1/14* (2013.01); *A41F 1/00* (2013.01); *A41F 18/00* (2013.01); *A41B 2400/38* (2013.01); *A41D 27/00* (2013.01); *A41D 2200/10* (2013.01); *A41D 2300/30* (2013.01); *A41D 2400/38* (2013.01)

(58) Field of Classification Search

CPC ..... A41D 1/22; A41B 2400/38

See application file for complete search history.

(56) References Cited

U.S. PATENT DOCUMENTS

| | | | | |
|---|---|---|---|---|
| 1,432,765 | A * | 10/1922 | Lindauer | A41C 1/00 450/125 |
| 2,115,398 | A * | 4/1938 | Rosenthal | A41C 3/00 450/62 |
| 3,378,013 | A * | 4/1968 | Bruno | A41C 3/00 450/58 |
| 8,337,275 | B2 * | 12/2012 | Martins-Crawbuck | A41C 3/0028 450/85 |
| 2005/0240134 | A1 * | 10/2005 | Brown | A61F 5/0106 602/26 |
| 2012/0045967 | A1 * | 2/2012 | Punsal | A41C 3/0057 450/82 |

* cited by examiner

*Primary Examiner* — Alissa J Tompkins
*Assistant Examiner* — Brieanna Szafran
(74) *Attorney, Agent, or Firm* — Mathew L. Grell; Jeffrey C. Watson; Grell & Watson Patent Attorneys LLC

(57) ABSTRACT

A body shaping garment element includes a garment and a bulge minimizer. The garment includes a superior edge, interior portion, and exterior portion. The bulge minimizer includes a stretchable element and a padded element. The stretchable element includes two ends and is affixed to the garment along the superior edge on the interior portion. The padded element may be removably placed between the stretchable element and the garment though a variety of means, thereby minimizing any bulging of adipose tissue of the wearer above the superior edge of the garment.

9 Claims, 7 Drawing Sheets

ADIPOSE TISSUE BULGE MINIMIZING SYSTEM AND METHODS OF USE

CROSS-REFERENCE TO RELATED APPLICATIONS

To the full extent permitted by law, the present United States Non-provisional patent application hereby claims priority to and the full benefit of, United States Provisional Application entitled "Bulge Hiding/Minimizing System and Methods of Use," having assigned Ser. No. 62/557,345, filed on Sep. 12, 2017, which is incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The instant disclosure relates to apparel elements, namely belt, strap, or strip constructions. More particularly, the instant disclosure relates to apparel elements designed to minimize the bulging of adipose tissue of the wearer of a garment above the edge of the garment where it meets exposed skin.

Description of the Related Art

Many fashionable and modern women's garments are designed to be form-fitting and reveal the skin of the wearer. Examples include strapless tops, low-cut skirts or trousers, and strapless dresses. These garments are often secured to the wearer by tightly conforming and encircling the wearer at and around the highest point on the garment. For a strapless top, the garment is often secured by tightly or adjustably encircling the wearer around the ribcage and back, beneath the armpit and above the bosom. For low-cut bottom garments, the garment is often secured by tightly or adjustably encircling the wearer just above the buttocks and beneath the upper portion of the pelvic bone. In either case, the garment may, depending on fit, be either too tight for the wearer and cause significant discomfort, or too loose on the wearer and cause significant adjustment, frustration, or even embarrassment due to gravity's effect on the garment during movement. Due to the constriction of adipose tissue, attempts to solve this issue often create in some wearers an unsightly bulge of adipose tissue above the edge of the garment. This bulge of adipose tissue may even hang over the garment or overlap the upper edge of the garment in such a manner that many wearers might or may find unflattering.

Apparel elements have been designed to comfortably secure such garments to wearers through a variety of means and mechanisms. Most commonly in upper body garments, straps or sleeves can hold the garment to the user without the need to closely conform to the dimensions of the wearer's body as a means to secure the garment to the wearer. Most commonly or traditionally in lower body garments, the design of the garment itself can conform to the wearer's waist size and fit above the hips and/or separate and fasten with a button or zipper to adjustably secure the lower body garment to the wearer and conveniently remove when changing clothing. Other lower body garments include loops for either a belt or suspenders to further secure the lower body garment above, at, or beneath the waist. However, as styles and tastes have evolved many wearers now prefer more revealing tops without sleeves or straps, strapless and sleeveless dresses, or low-cut and/or small-inseam lower body garments without the need for a belt or suspenders.

In order to secure a garment such as a more revealing top without straps or sleeves, a strapless and sleeveless dress, or a low-cut and/or small inseam lower body garment without the need for a belt or suspenders, the garment must be designed from materials that securely attach to the wearer's body or include apparel elements that secure the garment to the wearer during wear.

A common apparel element which allows for a range of sizes to be comfortably accommodated while securing a garment to a wearer without straps, sleeves, belt, or suspenders is an elastic belt attached to and encircling the inner portion of the garment. Other garments may also incorporate an attached encircling belt of gripping material, such as silicone, that when in contact with the wearer's skin, temporarily adheres through an adhesive, cling, or other adhering property of the material. Using either or a combination of these materials to constrict the garment around the wearer can comfortably secure the garment to the user and successfully prevent the effects of gravity from suddenly undressing the wearer, but do so by constricting the adipose tissue of the wearer. One disadvantage to this approach is a wearer with even moderate amounts of excess adipose tissue in a region that the garment constricts to secure to the wearer, may avoid wearing such a garment style to avoid unsightly bulges in exposed adipose tissue caused by the constriction. Some body positions, body types, and postures may even cause a situation where the adipose tissue exposed hangs over the edge of the garment in an unflattering manner.

Other apparel elements or undergarments are designed to provide wearers the appearance of more gradual curves to the contours of the wearer's body shape. Often referred to as support units or more commonly, a girdle, these undergarments are designed to be concealed underneath clothing that one would expose in public. Other common undergarments have been designed to offer similar results by including padding sewn into the garment or as inserts inserted into an internal pocket. While these undergarments have been effective to create the appearance of more gradual curves or excess curves to the contours of the wearer's body shape, by their very nature they are designed to be worn underneath the wearer's other clothing. One disadvantage to this approach is many wearers would prefer those that see them in public not be able to detect that they are wearing padded garments, and the exposure of such an undergarment, whether accidental or intentional, may be undesirable, unfashionable, or even embarrassing to many wearers. Additionally, many wearers may prefer the convenience or comfort of going out in public without needing to wear excessive or confining undergarments.

Other apparel may also be designed to provide the wearers the appearance of more gradual curves to the contours of the wearer's body shape while appearing to lack straps, sleeves, a belt, or suspenders, thereby limiting the extent to which any bulging of adipose tissue at the edge of the garment may occur. This is commonly achieved by including either straps or sleeves which are designed to resemble the wearer's skin, by including either straps or sleeves which are transparent to a degree where it may be unnoticed others, or by more permanently attaching to the wearer's skin through the use of chemical adhesives. One disadvantage to this approach is straps or sleeves, which are designed to resemble the wearer's skin, typically have the limitation that they are only effective in a narrow range of skin-tone and colors. Even a single wearer may vary in skin tone throughout time due to age, exposure to sun, skin conditions, disease, or other factors. Straps or sleeves, which are transparent to the degree where it may be unnoticed by others, are limited to the choice of materials and may have a glisten, shine, darkening, or translucence, which may affect their appeal to the wearer. Finally, more permanent attachment to the wearer's skin may incur the limitations of inconvenience, allergic reactions, discomfort, or loosening with perspiration, among other limitations.

Therefore, it is readily apparent that there is a recognized unmet need for a body shaping garment element to discretely minimize the bulging of adipose tissue above the garment edge when wearing form-fitting or revealing apparel while maintaining the apparel's ability to secure to the wearer's body. The instant disclosure is designed to address this need through either additions or alterations to existing clothing or manufacture of new clothing, which includes the apparel element disclosed herein while addressing at least some of the aspects of the problems discussed above.

SUMMARY

Briefly described, in a possibly preferred embodiment, the present disclosure overcomes the above-mentioned disadvantages and meets the recognized need for such an element by providing an adipose tissue bulge minimizing system and method of use, by providing, in general, a stretchable element affixed to the superior edge of a form fitting garment with a pad between the garment and stretchable element thereby minimizing the bulging of adipose tissue above the superior edge of the form fitting garment, and, thus, functions to retain the garment's ability to comfortably secure the garment to the wearer.

More specifically, the example embodiments of the present adipose tissue bulge minimizing system comprises a form-fitting garment, a stretchable element, and a pad. The form-fitting garment could be any number of garments designed to secure around the wearer without vertical support. Examples of garments include but are not limited to strapless shirts, strapless dresses, tube tops, skirts, and low-cut pants or shorts. Preferably, the stretchable element would be comprised of a thin elastic or SPANDEX band attached at each end, along the superior edge of the interior portion of the garment. The length of the stretchable element would ideally be shorter, when in its unstretched, natural state, than the distance between the end which each end is affixed to the garment, when measuring along the garment. The pad could be composed of a number of materials, including but not limited to, foam, plastic, paper, down, or cotton. The pad could be further comprised of fabric lined or encircling a soft inner portion or sewn to encapsulate a soft inner portion. As such, these elements when in combination, results in a minimization of the bulging of adipose tissue above the superior edge of a form-fitting garment while retaining the garment's ability to comfortably secure the garment to the wearer.

In an exemplary embodiment, the adipose tissue bulge minimizing system may include a body shaping garment element to minimize bulging of adipose tissue where exposed skin of a wearer meets a form-fitting garment edge. The body shaping garment element includes a garment, the garment having a superior edge, an interior portion, and an exterior portion and at least one bulge minimizer. The bulge minimizer includes at least one stretchable element with a first end and a second end, the first end and said second end affixed to the interior portion at the superior edge of the garment and at least one padded element designed to removably fit between the at least one stretchable element and the interior portion of the superior edge of the garment. In this exemplary embodiment, the bulge minimizer is affixed to the interior portion of the garment along the superior edge of the garment and configured to reduce bulging of adipose tissue along the superior edge of the garment.

In a further exemplary embodiment, the adipose tissue bulge minimizing method of use may include a method of minimizing the bulging of adipose tissue and concealing the appearance of bulging of adipose tissue where the exposed skin of a wearer meets a form-fitting garment edge. The method may include providing a garment with a superior edge, an interior portion, and an exterior portion, providing at least one stretchable element with a first end and a second end and at least one padded element, affixing the first end of the stretchable element to the interior portion of the superior edge of the garment, affixing the second end of the stretchable element to the interior portion of the superior edge of the garment at a greater distance along said superior edge than the unstretched length of the stretchable element, placing a padded element between the stretchable element and the interior portion of the superior edge of the garment, affixing at least one bulge minimizer to the interior portion of the garment along the superior edge, the bulge minimizer having a first end and a second end, and reducing any bulging of adipose tissue along the superior edge of the garment.

In select embodiments, the stretchable element may be composed of two pieces with a clasp to be positioned between the first end and the second end of the stretchable element. This would allow the wearer to choose between whether or not to use the adipose tissue bulge minimizing system or would allow for more convenient installation, configuration, and adjustment of the system.

In other embodiments, the stretchable element further may feature a cinch positioned between the first end and the second end. This would allow the wearer to adjust the length of the stretchable element to either further secure the garment to the wearer or to reduce the constriction of the garment around the wearer, increasing comfort.

A feature of the adipose tissue bulge minimizing system may be the means by which the stretchable element may be affixed to the interior portion at the superior edge of the garment. In one embodiment, the first end and second end of the stretchable element may be affixed to the interior portion at the superior edge of the garment by stitching each end sufficiently to permanently secure the stretchable element to the garment. In another embodiment, this may be accomplished through the use of at least one interlocking mechanism to removably attach the stretchable element. The interlocking mechanisms may include but are not limited to:

a hook and eye clasp, a hook and loop fastener fabric, a swimwear clasp, a garment snap, and a button combined with a buttonhole.

Another feature of the adipose tissue bulge minimizing system may be the means by which the padded element may be removably secured within the bulge minimizing system. In one embodiment, the padded element may be removably secured within at least one pocket affixed to the interior portion at said superior edge of the garment, with at least one opening sufficient to accommodate the padded element within the pocket. In another embodiment, the pad could be removably secured within the bulge minimizing system by using one or more of a variety of attachment mechanisms. These attachment mechanisms could be a hook and loop fastener fabric, a zipper, a snap, a button, a lace, a hook and eye clasp, or some combination thereof.

Yet another feature of the adipose tissue bulge minimizing system may be the means by which the padded element may be permanently secured within the bulge minimizing system. In an exemplary embodiment, the padded element may be permanently secured within the bulge minimizing system by sewing the padded element to the stretchable element. In another exemplary embodiment, the padded element may secured to the bulge minimizing system by sewing the padded element to the garment.

Another feature of the adipose tissue bulge minimizing system is its ability to incorporate a second stretchable element. The second stretchable element would have a first end and a second end and could be affixed to the interior portion at the superior edge of the garment at the first end and the second end of the second stretchable element. This second stretchable element could further constrict the garment to the wearer, while still minimizing the bulging of adipose tissue by utilizing the other components of the adipose tissue bulge minimizing system.

In use, a method of minimizing the bulging of adipose tissue may be providing a garment with a superior edge, an interior portion, and an exterior portion. Then providing at least one stretchable element with a first end and a second end and at least one padded element. The user could then affix the first and second ends of the stretchable element to the interior portion of the superior edge of the garment and place a padded element between the stretchable element and the interior portion of the superior edge of the garment, thereby reducing any bulging of adipose tissue along the superior edge of the garment.

In use, the method may vary as to how the stretchable element can be adjusted, how the stretchable element is attached, and how the padded element is secured. To allow the wearer to adjust the stretchable element, the user would provide a clasp or cinch positioned between the first end and the second end. The clasp could be used to allow the user to choose between using the bulge minimizing system or not and the cinch could allow the user to increase or decrease constriction of the garment around the wearer. The stretchable element could be attached to the garment through a variety of means. This includes being stitched to the superior edge of the interior portion of the garment at the first end and the second end of the stretchable element. Another means of attachment could include providing at least one interlocking mechanism such as a hook and eye clasp, a hook and loop fastener fabric, a swimwear clasp, a garment snap, or a button combined with a buttonhole. The padded element may be secured to the adipose tissue bulge minimizing system through a variety of means, including affixing at least one pocket to the garment, affixing an interlocking mechanism to the padded element, or sewing the padded element to the stretchable element or the garment. These interlocking mechanisms could include but are not limited to affixing a hook and loop fastener fabric, affixing a zipper, affixing a snap, affixing a button, affixing a lace, and a hook and eye clasp. Finally, a second shorter stretchable element could be affixed directly to the garment underneath the remaining portion of the adipose tissue bulge minimizing system.

These and other features of the Adipose Tissue Bulge Minimizing System and Methods of Use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present adipose tissue bulge minimizing system and method of use will be better understood by reading the Detailed Description with reference to the accompanying drawings, which are not necessarily drawn to scale, and in which like reference numerals denote similar structure and refer to like elements throughout, and in which.

Figure 1:
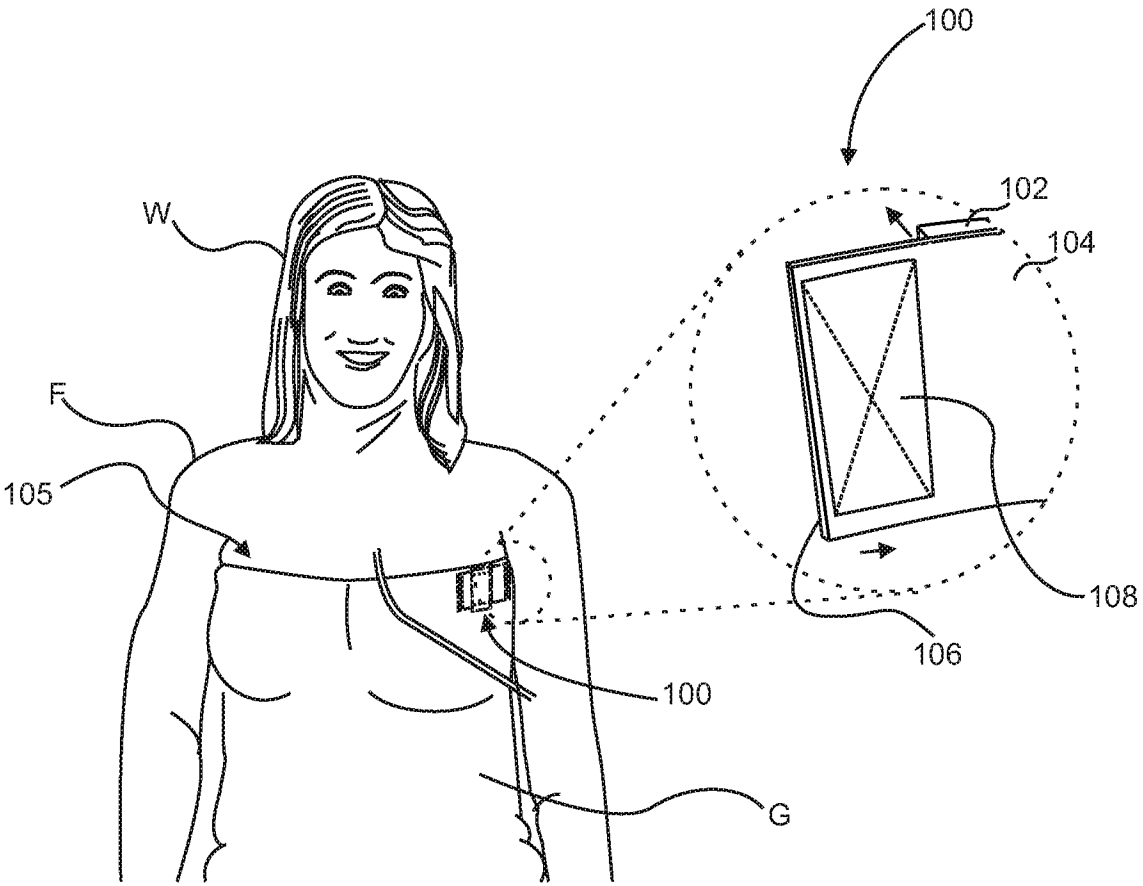
FIG. 1 is a front perspective view of a wearer of a form-fitting top garment, and an enlarged front sectional view of an adipose tissue bulge minimizing system beneath one side of the garment.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1, 2, 3A, 3B, 4, 5, and 6, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1, 2, 3A, 3B, and 4 by way of example, and not limitation, therein is illustrated example embodiments of adipose tissue bulge minimizing system 100. Adipose tissue bulge minimizing system 100 may be referred herein as just system 100. System 100 may be used on garment G. Although garment G is shown in the drawings as a strapless top, the disclosure is not so limited, and system 100 may be used on any laterally secured form-fitting garment or the like, including, but not limited to: strapless shirts, strapless dresses, tube tops, skirts, and low-cut pants, the like, and/or combinations thereof.

In one embodiment, system 100 may provide the following elements: a stretchable element 104 (see FIGS. 1, 2, 3A, 3B, 4, and 5), a padded element 102 (see FIGS. 1, 2, 3A, 3B, 4, and 5), and a garment G having a superior edge 109 (see FIGS. 1, 2, 3A, 3B, and 4). Further enhancing its capabilities, system 100 may permanently secure garment G to stretchable element 104 by using a stitch 108 (see FIGS. 1, 2, and 4), or may removably attach using an interlocking mechanism such as first element of interlocking garment clasp 126 and second element of interlocking garment clasp 127 or hook fastener 136 and loop fastener 137 (see FIGS. 3A and 3B). System 100 may be intended as a versatile garment element, the use of which may appeal to any wearer W of laterally secured form-fitting garments, wherein the wearer may wish to reduce a bulging of adipose tissue above the superior edge of a garment.

System 100 may generally include at least one pocket element 140, first element of interlocking garment clasp 126 and second element of interlocking garment clasp 127, hook fastener 136 and loop fastener 137, and system 200 may include second stretchable element 206. These elements will be described in greater detail below.

System 100 may generally be formed by stretchable element 104. Stretchable element 104 of system 100 may provide the overall shape, size and structure of system 100. Stretchable element 104 of system 100 may include or be made from a band of stretchable fabric configured to be secured along garment G along superior edge 109 at a length sufficient to accommodate padded element 102 of system 100 between garment G and stretchable element 104 of system 100. System 100 may be configured as one element to attach to the garment G, or as multiple, interchangeable and adjustable elements. As examples, and clearly not limited thereto, stretchable element 104 of system 100 can be constructed of such materials as elastic, rubber, silicone, stretchable fabric blend, or the like, or combinations thereof. Stretchable element 104 of system 100 may be affixed at each end 106 to garment G at varying lengths. One skilled in the art could determine where to affix each end 106 by first measuring a first length, or the length of the stretchable element 104 when in its unstretched state. Stretchable element 104 would then preferably be affixed to garment G at a second length apart, the second length being greater than the first length. Different materials of stretchable element 104 of system 100 may result in different constricting capabilities. Thus, stretchable element 104 of system 100 may be designed out of different materials for various styles and sizes of garments.

It is further contemplated that stretchable element 104 of system 100 could be manufactured from one or more circular stretchable bands wherein no true end would be discernible. In such cases, one skilled in the art could consider any portion where stretchable element 104 is affixed to garment G as an end and so long as stretchable element 104 attaches to garment G in at least one position along stretchable element 104, system 100 could be created using the same or similar elements in the same or similar manner to provide the same or similar function.

System 100 may further generally include padded element 102. Padded element 102 of system 100 may be secured to stretchable element 104 of system 100, or in an alternative embodiment, be secured in place removably in pocket element 140 of system 100. Padded element 102 of system 100 should generally conform to a length short enough to fit lengthwise along stretchable element 104 of system 100 between stretchable element 104 of system 100 and garment G along superior edge 109 such that it would not need to fold or bunch when worn against wearer W. System 100 may be configured as one element to attach to the garment G, or as multiple, interchangeable elements. As examples, and clearly not limited thereto, padded element 102 of system 100 can be constructed of such as thick fabric, foam, miniature down pillow, pocketed gel, or the like, or combinations thereof. Different materials of padded element 102 of system 100 may result in different constricting capabilities. Thus, padded element 102 of system 100 may be designed out of different materials for various sizes and styles of garments.

Figure 2:
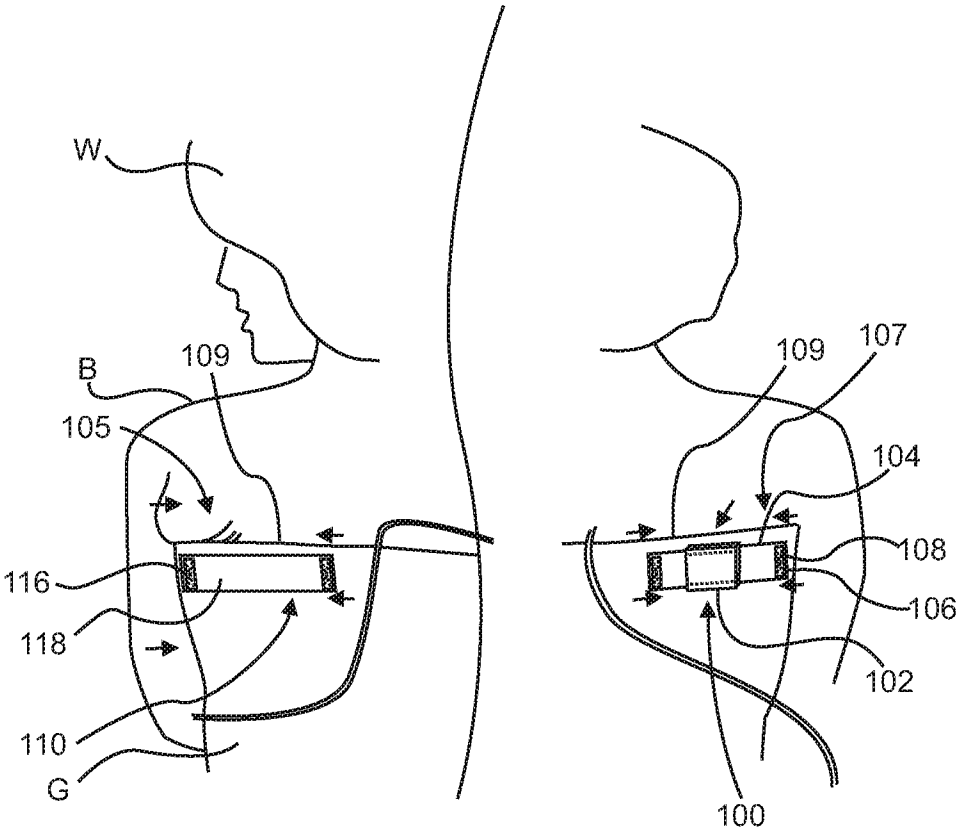
FIG. 2 is a rear perspective view of a wearer of a form-fitting top garment with a front sectional view of systems beneath the garment.
Figure 4:
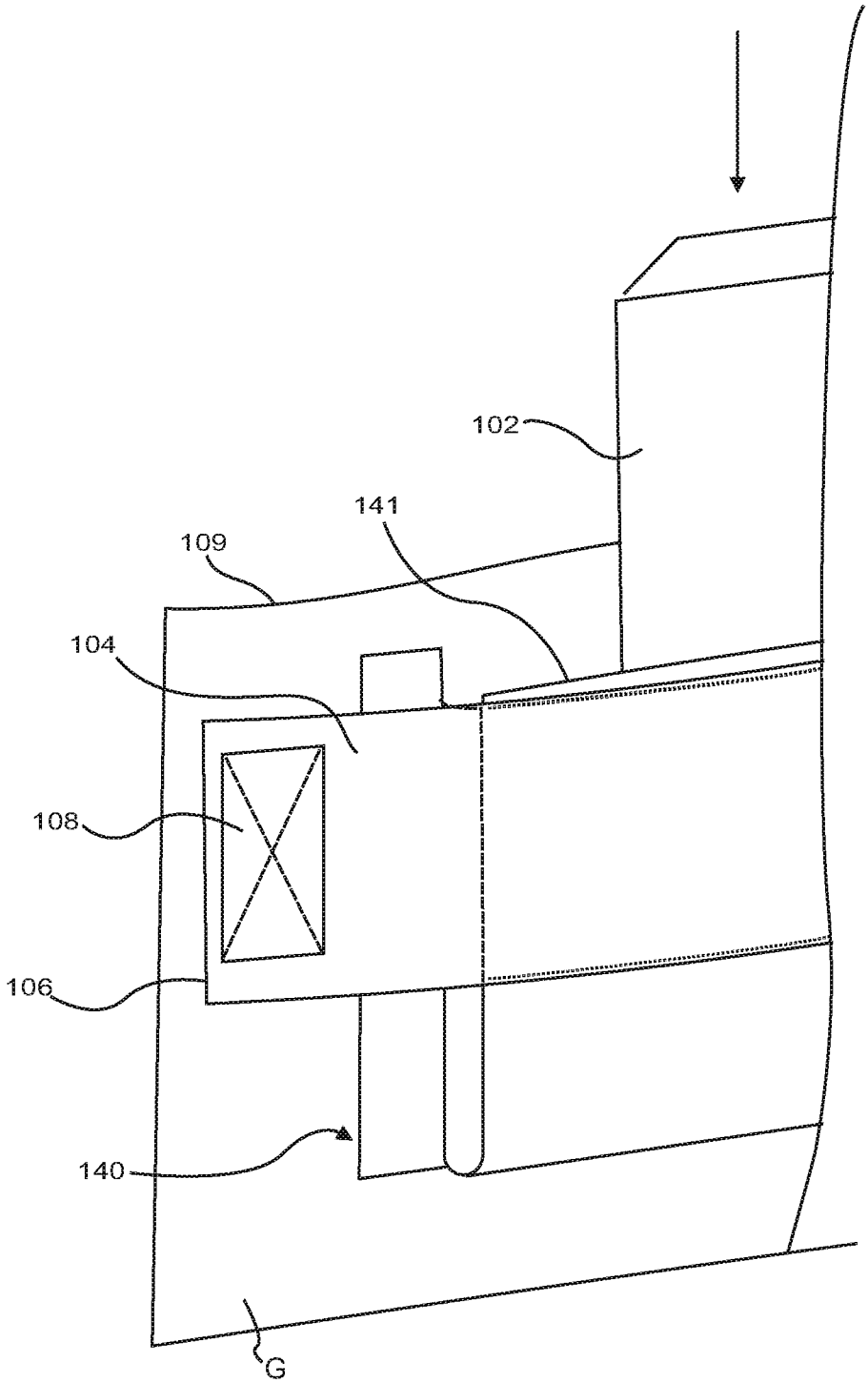
FIG. 4 is a rear sectional view of a select embodiment of an adipose tissue bulge minimizing system.

Referring now more specifically to FIGS. 1, 2, and 4, stretchable element 104 may be permanently secured at each end 106 to garment G at superior edge 109 using stitches 108. In this configuration of system 100, it may be important that padded element 102 may be sufficiently sized to fit between the stitches 108 on each end 106 of stretchable element 104. In this configuration of system 100, may also be important to secure padded element 102 to stretchable element 104 by a number of means. These could include stitching padded element 102 to stretchable element 104 or providing a means of removably attaching padded element 102 to stretchable element 104.

Referring now more specifically to FIG. 2, illustrated therein is an example of a prior art garment constriction system 110 alongside of system 100 as viewed in perspective of wearer W from the back B. The prior art garment constriction system 110 may be constructed from a stretchable element 118 affixed to garment G. The tension of material constricting along the superior edge 109 of garment G may cause bulging of adipose tissue 105 above superior edge 109 in prior art garment constriction system 110. By comparison, when combining stretchable element 104 with padded element 102 along superior edge 109 of garment G, an area of reduced or no bulging of adipose tissue 107 is present above superior edge 109 of garment G.

Figure 3A:
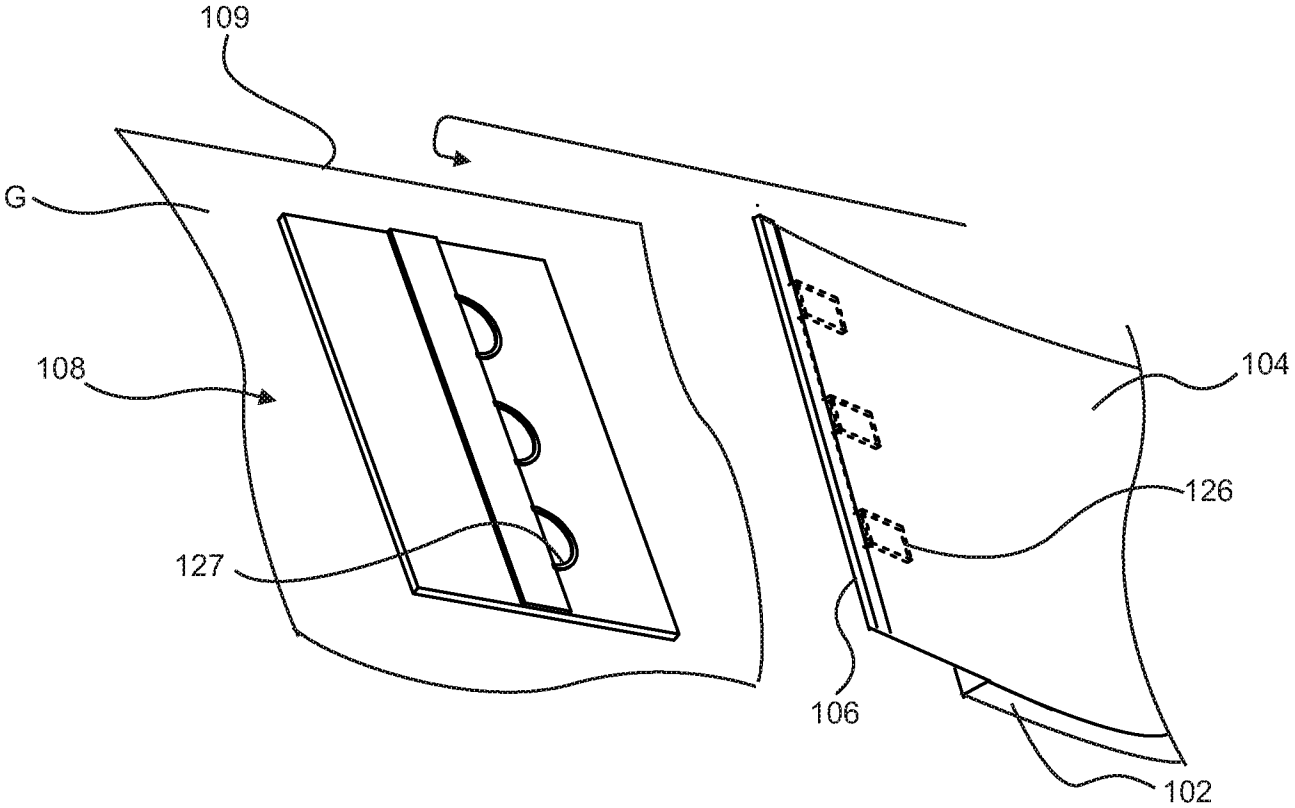
FIG. 3A is an exploded view of a select embodiment of an adipose tissue bulge minimizing system.
Figure 3B:
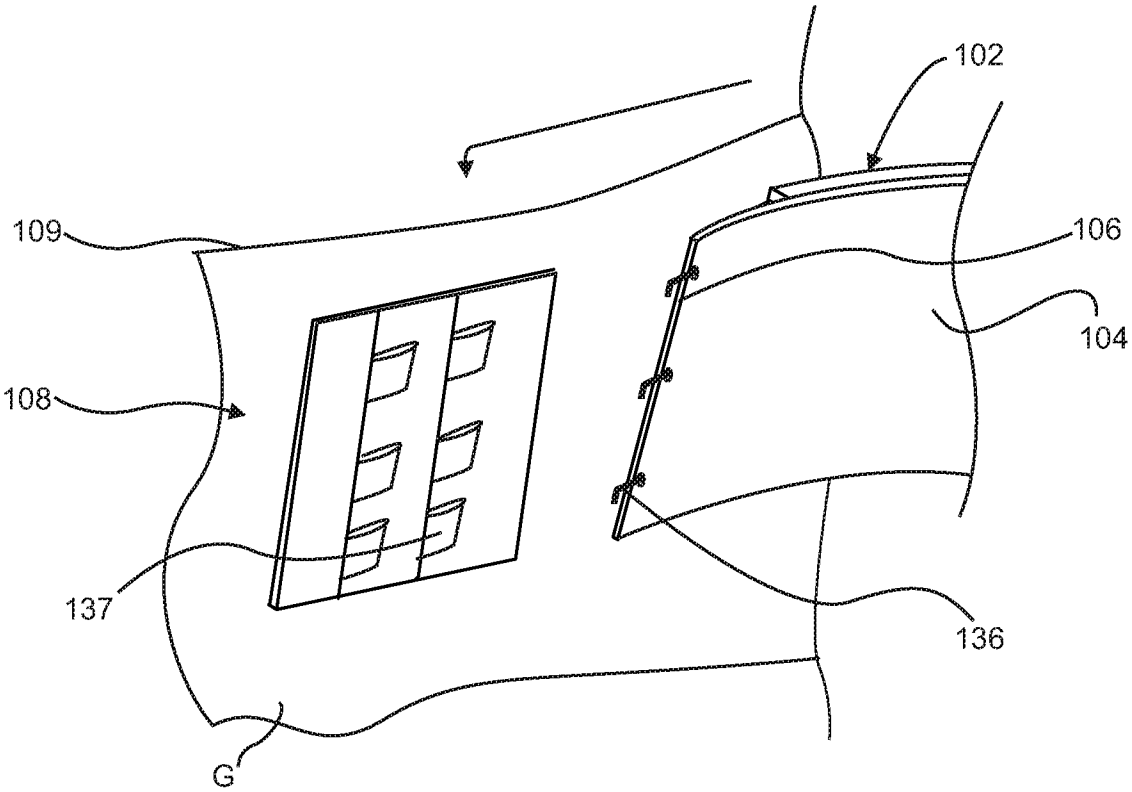
FIG. 3B is an exploded view of a select embodiment of an adipose tissue bulge minimizing system.

Referring now more specifically to FIGS. 3A and 3B, illustrated therein is an example of system 100, where the alternate embodiments of FIGS. 3A and 3B are substantially equivalent in form and function to that of the preferred embodiment detailed and illustrated in FIGS. 1, 2, and 4 except as hereinafter specifically referenced. Specifically, the embodiments of FIGS. 3A and 3B include stretchable element 104 of system 100. Stretchable element of system 100 may be removably attached to garment G at superior edge 109. This may be accomplished by affixing first element of interlocking garment clasp 126 to the stretchable element 104 at its end 106 and second element of interlocking garment clasp 127 to garment G near superior edge 109. This may also be accomplished by affixing a hook fastener 136 to the stretchable element 104 at its end 106 and loop fastener 137 to garment G near superior edge 109. These are only exemplary embodiments of means to removably attach stretchable element 104 to garment G near superior edge 109. One skilled in the art may understand a group of other means to removably attach stretchable element 104 of system 100 to garment G near superior edge 109, the group including but not limited to: a button and a buttonhole and hook, a garment snap, loop fastener fabric, the like, and combinations thereof. Different interlocking mechanisms of system 100 may result in different removability. Thus, the choice of interlocking mechanism of system 100 may be designed out of different mechanisms for various sizes, functions, capabilities, and styles of garments.

Referring now more specifically to FIG. 4, illustrated therein is an example of system 100, where the alternate embodiment of FIG. 4 is substantially equivalent in form and function to that of the preferred embodiment detailed and illustrated in FIGS. 1, 2, 3A, and 3B except as hereinafter specifically referenced. Specifically, the embodiment of FIG. 4 include pocket element 140 of system 100. Pocket element 140 of system 100 may be designed to accommodate padded element 102 of system 100, which may securely confine padded element 102 of system 100 between stretchable element 104 of system 100 and garment G at superior edge 109 via opening 141 of pocket element 140 of system 100. Opening 141 of pocket element 140 of system 100, as illustrated herein, may be configured to open along garment G near superior edge 109, but may also be configured in any number of directions so long as pocket element 140 may accommodate padded element 102 between stretchable element 104 and garment G along superior edge 109 of system 100. System 100 may be configured as one element to attach to the garment G, or as multiple, interchangeable and adjustable elements. As examples, and clearly not limited thereto, pocket element 140 of system 100 may be constructed of such materials as cotton, linen, silk, polyester, plaid, rayon, material conforming to the material of the garment or liner, or the like, or combinations thereof. Different materials of pocket element 140 of system 100 may result in different securing capabilities. Thus, pocket element 140 of system 100 may be designed out of different materials for various styles of garments. One skilled in the art may understand a group of alternative means or group of interlocking mechanisms, the group could include a first element and a second element, and may removably attach padded element 102 of system 100 to garment G near superior edge 109 or to stretchable element 104 of system 100 by attaching the first element at padded element 102 and the second element either at stretchable element 104 or near superior edge 109 of garment G, the group of means or group of interlocking mechanisms including but not limited to: a hook and loop fastener fabric, a zipper, a snap, a button, a lace, a hook and eye clasp, the like, and combinations thereof.

Figure 5:
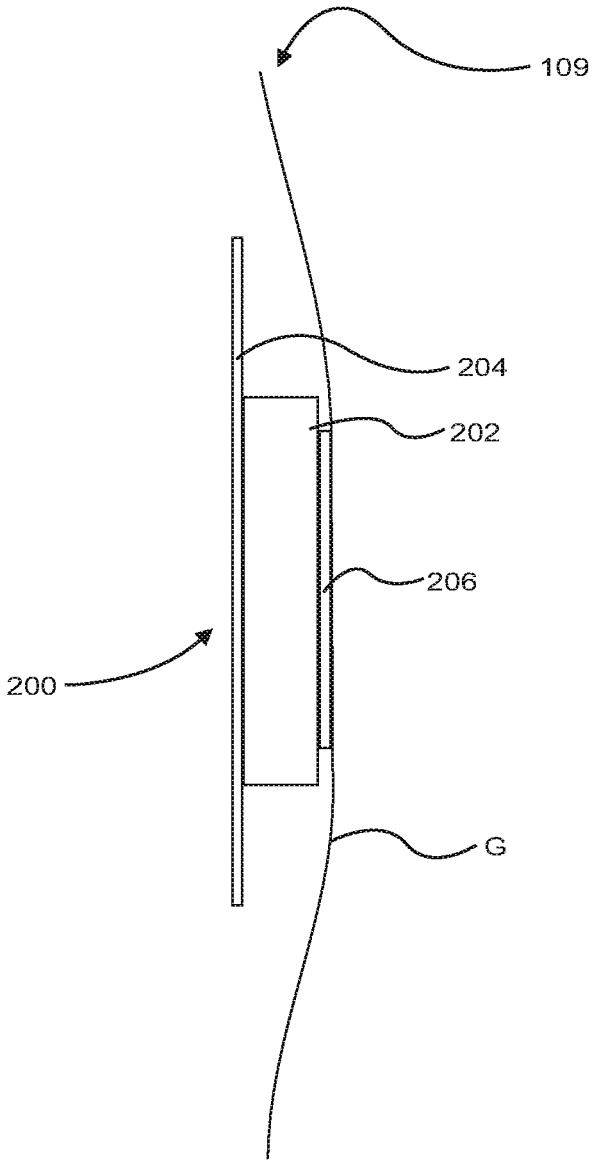
FIG. 5 is a cross sectional view of a select embodiment of an adipose tissue bulge minimizing system.

Referring now to FIG. 5 by way of example, and not limitation, therein is illustrated an example embodiment of adipose tissue bulge minimizing system 200. Adipose tissue bulge minimizing system 100 may be referred herein as just system 200. System 200 may be used on garment G. Although garment G is shown in other drawings as a strapless top, the disclosure is not so limited, and system 200 may be used on any laterally secured form-fitting garment or the like, including, but not limited to: strapless shirts, strapless dresses, tube tops, skirts, and low-cut pants, the like, and/or combinations thereof.

In one embodiment, system 200 may provide the following elements: a first stretchable element 204 (see FIGS. 1, 2, 3A, 3B, 4, and 5), a padded element 202 (see FIGS. 1, 2, 3A, 3B, 4, and 5), a second stretchable element 206, and a garment G having superior edge 209 (see FIGS. 1, 2, 3A, 3B, 4, and 5). Further enhancing the capabilities of system 100, system 200 may add the second stretchable element 206 of system 200. Second stretchable element 206 of system 200 serves to further constrict garment G around wearer W, thereby securing it in place. In combination with other elements of system 200, including but not limited to first stretchable element 204, padded element 202, and garment G having superior edge 209, system 200 may function to reduce or minimize adipose tissue bulging above superior edge 209 of system 200 while enhancing also the security of garment G to wearer W.

A distinction of system 200 in comparison to system 100 preferably is generally be the inclusion of second stretchable element 206. Second stretchable element 206 of system 200 may provide the overall shape, size and structure of system 200. Stretchable element 204 of system 200 may include or be constructed from a band of stretchable fabric configured to be secured along garment G along superior edge 209 at a length sufficient to be accommodated beneath padded element 202 and first stretchable element 204 of system 200 between garment G and padded element 202 of system 100. System 200 may be configured as one element to attach to the garment G, or as multiple, interchangeable and adjustable elements. As examples, and clearly not limited thereto, stretchable element 204 of system 200 can be constructed of such materials as elastic, rubber, silicone, stretchable fabric blend, or the like, or combinations thereof. Different materials of stretchable element 204 of system 200 may result in different constricting capabilities. Thus, stretchable element 204 of system 200 may be designed out of different materials for various sizes and styles of garments.

It is contemplated that system 100 and system 200 can be applied to a variety of garment types in a variety of locations. System 100 and system 200 may be used on any laterally secured form-fitting garment or the like, including, but not limited to: strapless shirts, strapless dresses, tube tops, skirts, and low-cut pants or shorts, the like, and/or combinations thereof. Depending on the body shape of wearer W and how constricting garment G is to wearer W, system 100 and system 200 may also be located at one or multiple locations along superior edge 109 of any garment G. System 100 or system 200 may be used individually or in combination to achieve the result of minimizing the bulging of adipose tissue along superior edge 109 of garment G. Additionally, it is contemplated that system 100 and/or system 200 may be incorporated into the manufacture of garment G or may be applied afterward to garment G as an alteration by a professional or consumer.

It is contemplated herein that system 100 and/or system 200 may be utilized to reduce or eliminate bulging of adipose tissue 105 above superior edge 109 of garment G.

It is further contemplated herein that system 100 and/or system 200 (padded element 102) may be utilized to redistribute the grip or linear grip thereof superior edge 209 of garment G to reduce or eliminate bulging of adipose tissue 105 above superior edge 109 of garment G.

Figure 6:
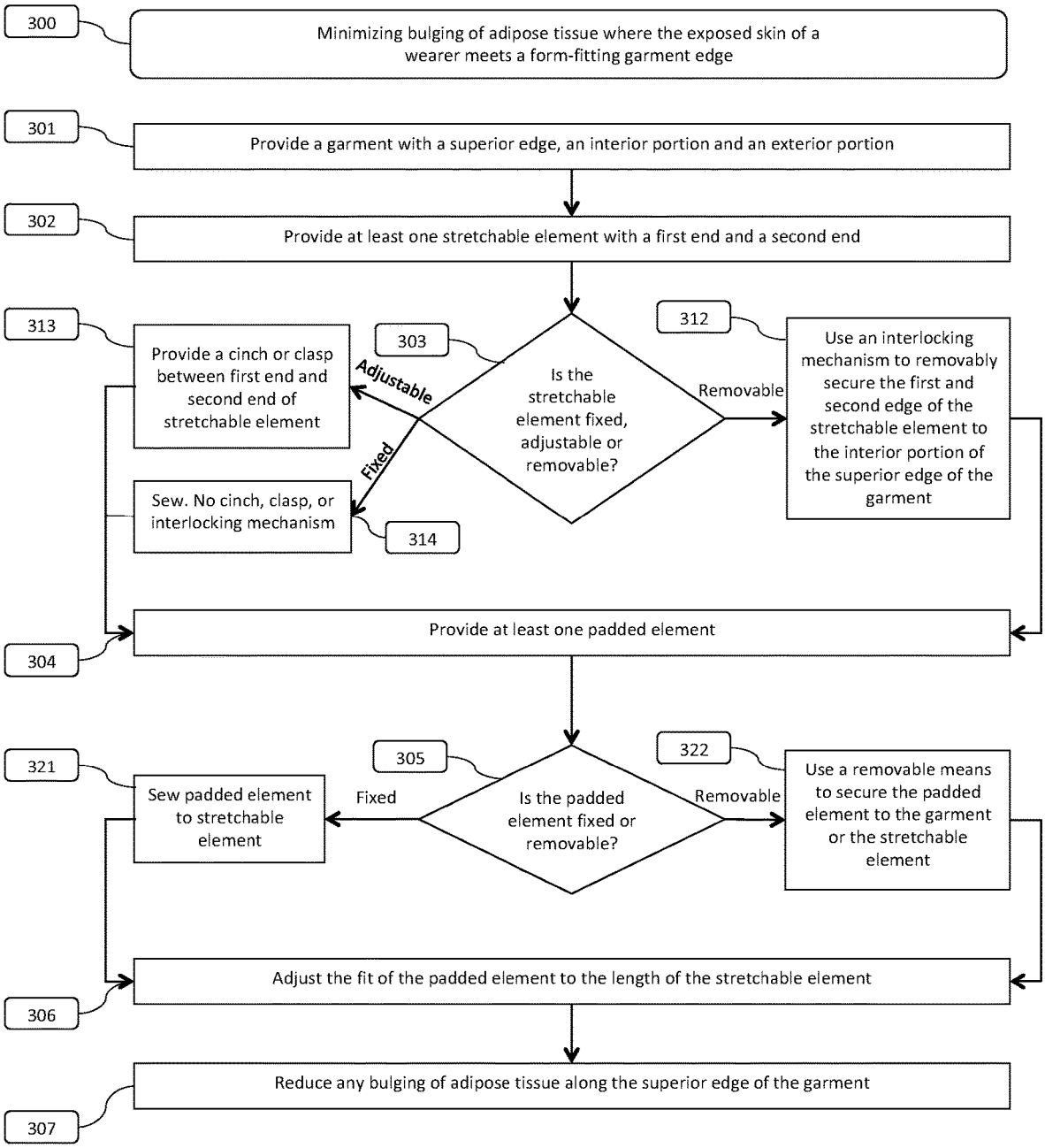
FIG. 6 is a flow chart of a select embodiment of a method of minimizing an adipose tissue bulge.

Referring now more specifically to FIG. 6, there is illustrated a flow diagram of a method of minimizing bulging of adipose tissue where the exposed skin of wearer W meets form-fitting garment G at superior edge 109, or method 300. In step 301, providing a garment G with superior edge 109, an interior portion, and an exterior portion, as described above in FIGS. 1-5. In step 302, providing at least one stretchable element 104 with a first end and a second end 106 as described above in FIGS. 1-5. In step 303, determining whether to permanently affix stretchable element 104 to garment G, allow adjustment of stretchable element 104 within system 100, or removably affix stretchable element 104 within system 100. To permanently affix stretchable element 104 to garment G, in step 314, sewing stretchable element 104 to garment G at each end 106, thereby permanently affixing stretchable element 104 to garment G within system 100, as described above in FIGS. 1, 2, and 4. To allow adjustment of stretchable element 104 within system 100, in step 313, providing a cinch or clasp between the ends 106 of stretchable element 104, thereby allowing the user to further constrict stretchable element 104 using a cinch or release the tension completely using a clasp. To removably affix stretchable element 104 to garment G, in step 312, using an interlocking mechanism to removably secure at each end 106 the stretchable element 104 to the garment G along the superior edge 109, as described above in FIGS. 3A and 3B. In step 304, providing padded element 102, as described above in FIGS. 1-5. In step 305, determining whether to permanently affix padded element 102 within system 100 or whether to removably secure padded element 102 within system 100. To permanently affix padded element 102 within system 100, in step 321, sewing padded element 102 to stretchable element 104, as described above in FIGS. 1, 2, 3A, and 3B. In alternative embodiments of method 300, padded element 102 may alternatively be permanently affixed within system 100 by sewing padded element 102 to garment G or to garment G and stretchable element 104. To removably affix padded element 102 within system 100, in step 322, use a removable means to secure padded element 102 to garment G or stretchable element 104, as described above in FIG. 4. If the padded element 102 does not already fit to the length of stretchable element 104, at step 306, padded element may be adjusted to fit the length of stretchable element 104. When completed at step 307, reducing or eliminating any bulging of adipose tissue 105 along superior edge 109 of garment G, resulting in an area of reduced or no bulging of adipose tissue 107 as described above in FIGS. 1, 2, 3A, 3B, and 4.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A body shaping garment element to minimize a bulging of adipose tissue where an exposed skin of a wearer meets a form-fitting garment edge, said body shaping garment element comprising:

a garment, said garment having a superior edge, an interior portion, and an exterior portion;

an at least one bulge minimizer, said bulge minimizer having at least one stretchable element with a first end and a second end, said first end and said second end affixed to said interior portion at said superior edge of said garment, and at least one padded element designed to removably fit between said at least one stretchable element and said interior portion of said superior edge of said garment; and a pocket affixed to said interior portion at said superior edge of said garment, said pocket having an at least one opening sufficient to accommodate said padded element within said at least one pocket;

wherein said at least one bulge minimizer is affixed to said interior portion of said garment along said superior edge of said garment and configured to reduce said bulging of adipose tissue along said superior edge of said garment.

2. The body shaping garment element of claim 1, further comprises a clasp positioned between said first end and said second end.

3. The body shaping garment element of claim 1, further comprises a cinch positioned between said first end and said second end to reduce said bulging of adipose tissue.

4. The body shaping garment element of claim 1, where said first end and said second end of said stretchable element are stitched to said interior portion at said superior edge of said garment.

5. The body shaping garment element of claim 1, further comprises an at least one interlocking mechanism having a first element and a second element from a group of interlocking mechanisms comprising a hook and eye clasp, a hook and loop fastener fabric, a swimwear clasp, a garment snap, and a button combined with a buttonhole, said first element positioned and affixed on at least one of said first end and said second end of said stretchable element at one element and said second element positioned and affixed to said interior portion at said superior edge of said garment.

6. A body shaping garment element to minimize a bulging of adipose tissue where an exposed skin of a wearer meets a form-fitting garment edge, said body shaping garment element comprising:

a garment, said garment having a superior edge, an interior portion, and an exterior portion; and an at least one bulge minimizer, said bulge minimizer having at least one stretchable element with a first end and a second end, said first end and said second end affixed to said interior portion at said superior edge of said garment, and at least one padded element designed to removably fit between said at least one stretchable element and said interior portion of said superior edge of said garment, said padded element is sewn to said stretchable element;

wherein said at least one bulge minimizer is affixed to said interior portion of said garment along said superior edge of said garment and configured to reduce said bulging of adipose tissue along said superior edge of said garment.

7. The body shaping garment element of claim 1, further comprises at least one interlocking mechanism having a first element and a second element from a group of interlocking mechanisms, said first element affixed to said interior portion of said garment and said second element affixed to said padded element, said group of interlocking mechanisms comprising a hook and loop fastener fabric, a zipper, a snap, a button, a lace, and a hook and eye clasp.

8. The body shaping garment element of claim 1, further comprises said padded element is sewn to said stretchable element.

9. A body shaping garment element to minimize a bulging of adipose tissue where an exposed skin of a wearer meets a form-fitting garment edge, said body shaping garment element comprising:

a garment, said garment having a superior edge, an interior portion, and an exterior portion;

a first stretchable element with a first end and a second end, said first end and said second end affixed to said interior portion at said superior edge of said garment; and an at least one bulge minimizer, said bulge minimizer having a second stretchable element with a first end and a second end, said first end and said second end affixed to said interior portion at said superior edge of said garment and having at least one padded element designed to removably fit between said second stretchable element and said interior portion of said superior edge of said garment; and a pocket affixed to said interior portion at said superior edge of said garment, said pocket having an at least one opening sufficient to accommodate said padded element within said at least one pocket;

wherein said at least one bulge minimizer is affixed to said interior portion of said garment along said superior edge of said garment and configured to reduce said bulging of adipose tissue along said superior edge of said garment.

* * * * *